US009765446B2

(12) United States Patent
Scherer

(10) Patent No.: US 9,765,446 B2
(45) Date of Patent: Sep. 19, 2017

(54) BLACK COLORING FOR FIBERS

(75) Inventor: Guenter Scherer, Neustadt (DE)

(73) Assignee: BASF SE, Ludwigshafen (DE)

( * ) Notice: Subject to any disclaimer, the term of this patent is extended or adjusted under 35 U.S.C. 154(b) by 989 days.

(21) Appl. No.: 12/994,197

(22) PCT Filed: Jun. 2, 2009

(86) PCT No.: PCT/EP2009/056748

§ 371 (c)(1),
(2), (4) Date: Nov. 23, 2010

(87) PCT Pub. No.: WO2009/147143

PCT Pub. Date: Dec. 10, 2009

(65) Prior Publication Data

US 2011/0064935 A1 Mar. 17, 2011

(30) Foreign Application Priority Data

Jun. 4, 2008 (EP) ..... 08157581

(51) Int. Cl.
*D01F 1/04* (2006.01)
*D01F 1/06* (2006.01)
*D03D 15/00* (2006.01)

(52) U.S. Cl.
CPC ..... *D01F 1/04* (2013.01); *D03D 15/0033* (2013.01); *Y10T 428/249921* (2015.04)

(58) Field of Classification Search
CPC ... D01F 1/04; D03D 15/0033; C09B 67/0033; C09B 5/62
See application file for complete search history.

(56) References Cited

U.S. PATENT DOCUMENTS

| | | | | |
|---|---|---|---|---|
| 2,494,391 | A * | 1/1950 | Johnson et al. | 8/490 |
| 3,628,976 | A * | 12/1971 | Stocker | 106/278 |
| 3,871,882 | A * | 3/1975 | Wiedemann | 430/58.5 |
| 3,904,407 | A * | 9/1975 | Regensburger et al. | 430/58.6 |
| 3,972,717 | A * | 8/1976 | Wiedemann | 430/65 |
| 6,403,796 | B1 * | 6/2002 | Duff et al. | 546/37 |
| 6,416,859 | B1 * | 7/2002 | Caswell et al. | 428/364 |
| 6,464,902 | B1 * | 10/2002 | Gaynor et al. | 252/600 |
| 6,997,983 | B2 * | 2/2006 | Chamberlain et al. | 106/493 |
| 7,008,694 | B1 * | 3/2006 | Frankel | 428/364 |
| 7,083,675 | B2 * | 8/2006 | Mizuguchi et al. | 106/498 |
| 7,416,601 | B2 * | 8/2008 | Erk et al. | 106/498 |
| 8,236,714 | B2 * | 8/2012 | Frankel | 442/301 |
| 8,796,365 | B2 * | 8/2014 | Maletzko et al. | 524/90 |
| 2003/0105325 | A1 * | 6/2003 | Weber et al. | 546/37 |
| 2004/0068046 | A1 * | 4/2004 | Hugo | 524/556 |
| 2004/0217512 | A1 * | 11/2004 | Babler et al. | 264/176.1 |
| 2004/0255821 | A1 * | 12/2004 | Mizuguchi et al. | 106/493 |
| 2006/0058330 | A1 * | 3/2006 | Krieger et al. | 514/279 |
| 2006/0112852 | A1 * | 6/2006 | Klopp et al. | 106/31.78 |
| 2006/0135774 | A1 * | 6/2006 | Weber et al. | 546/37 |
| 2007/0151478 | A1 * | 7/2007 | Erk et al. | 106/31.6 |
| 2008/0102724 | A1 * | 5/2008 | Frankel | 442/301 |

(Continued)

FOREIGN PATENT DOCUMENTS

| | | |
|---|---|---|
| CH | 373844 | 1/1964 |
| DE | 199 28 235 | 4/2000 |

(Continued)

OTHER PUBLICATIONS

Yang et al., "Studying the mechanisms of titanium dioxide as ultraviolet-blocking additive for films and fabrics by an improved scheme," Journal of Applied Polymer Science, vol. 92, pp. 3201-3210 (2004).*

(Continued)

*Primary Examiner* — Jeremy R Pierce
(74) *Attorney, Agent, or Firm* — Oblon, McClelland, Maier & Neustadt, L.L.P.

(57) ABSTRACT

Fibers, especially black, brown or gray fibers, comprising IR-transparent colorants. IR-transparent colorants may be di-, tri- or polychromatic dyes or pigments, especially perylene pigments. The fibers may comprise perylene pigments which comprise one of the isomers of the formula Ia or Ib Ia Ib in which the $R^1$ and $R^2$ radicals are each independently phenylene, naphthylene or pyridylene, each of which may be mono- or polysubstituted by $C_1$-$C_{12}$-alkyl, $C_1$-$C_6$-alkoxy, hydroxy and/or halogen, or a mixture of the two isomers. Useful fiber materials include plastics or glass. The fibers find use, among other uses, in heat management or for production of textiles or fabrics.

7 Claims, No Drawings

(56) References Cited

U.S. PATENT DOCUMENTS

| | | | | |
|---|---|---|---|---|
| 2010/0040856 | A1* | 2/2010 | Berndt et al. | 428/221 |
| 2010/0190897 | A1* | 7/2010 | Maletzko et al. | 524/86 |
| 2011/0064935 | A1* | 3/2011 | Scherer | 428/221 |

FOREIGN PATENT DOCUMENTS

| | | | |
|---|---|---|---|
| DE | 10 2006 053070 | | 5/2008 |
| EP | 1 240 243 | | 9/2002 |
| FR | 1 468 622 | | 2/1967 |
| GB | 972 485 | | 10/1964 |
| JP | 60 195029 | | 10/1985 |
| JP | 63-190009 | A | 8/1988 |
| JP | 07 157681 | | 6/1995 |
| WO | 00 24833 | | 5/2000 |
| WO | 02 057374 | | 7/2002 |
| WO | 2005 078023 | | 8/2005 |
| WO | 2006 058782 | | 6/2006 |
| WO | 2009 000830 | | 12/2008 |

OTHER PUBLICATIONS

Merzbacher et al., "Carbon aerogels as broadband non-reflect materials," Journal of Non-Crystalline Solids, 285, pp. 210-215 (2001).*

International Search Report issued Dec. 16, 2010 in PCT/EP09/056748 filed Jun. 2, 2009.

* cited by examiner

BLACK COLORING FOR FIBERS

This application is a National Stage of PCT/EP09/056748 filed Jun. 2, 2009 and claims the benefit of EP 08157581.3 filed Jun. 4, 2008.

The present invention relates to fibers, which comprise IR-transparent colorants. The present invention further relates to processes for producing such fibers. Uses of the IR-transparent colorants, especially in heat management, likewise form part of the subject matter of the invention. The invention further provides materials which comprise such fibers.

Further embodiments of the present invention can be inferred from the claims, the description and the examples. It will be appreciated that the features of the inventive subject matter which have been specified above and are yet to be explained below can be used not just in the particular combination specified, but also in other combinations without leaving the scope of the invention. Preferred and very preferred embodiments of the present invention are those in which all features have the preferred and very preferred definitions.

DE 199 28 235 A describes a spectrally selective coating, which has a high reflectance in the wavelength range of 700-2500 nm and as a result causes a low solar absorption. This coating comprises (a) a binder, which, in the thermal infrared wavelength range (2.5-50 micrometers), has a transmittance greater than 40%, (b) first pigments, which, in the thermal infrared wavelength range, have a transmittance greater than 40% and (c) second pigments, which, in the thermal infrared wavelength range, have a reflectance greater than 40%.

WO 00/24833 describes a spectrally selective coating comprising a) a binder with a transmittance of 60% or more in the wavelength range from 700 to 2500 nm, and with a transmittance of 40% or more in the thermal infrared wavelength range; b) first pigments which absorb 40% or more of the visible light in the wavelength range from 350 to 700 nm, have a backscatter of 40% or more in the near infrared from 700 to 2500 nm and have an absorption of 60% or less in the thermal infrared wavelength range; c) second pigments which have a backscatter and/or reflectance of 40% or more in the thermal infrared wavelength range.

WO 02/057374 A1 describes a coating, which absorbs in the invisible regions of the solar spectrum, i.e. in the ultraviolet and in the infrared, has a higher reflectance than customary colors and as a result absorbs less solar energy.

WO 02112405 A2 relates to a flat element, consisting of a substrate and at least one coating of the substrate. Both the substrate and the surface are dark-colored in the visible region. In the near infrared region this arrangement has a high reflectance in order to reduce heating under sunlight in spite of the dark coloration in the visible region.

WO 2005/078023 A2 describes black perylene pigments and mixtures thereof, which have a high blackness value. In addition, WO 2005/078023 A2 discloses the preparation of the perylene pigments and, among other uses, their use for coloring high molecular weight organic and inorganic materials of natural and synthetic origin. Examples of high molecular weight synthetic organic materials specified in WO 2005/078023 A2 are, for example: polyolefins, PVC, polycarbonate, polyesters and other polymers. The perylene pigments can be incorporated into the polymers, according to WO 2005/078023 A2, for example, by combined extrusion, rolling, kneading, pressing or grinding, and the plastics can be processed to shaped plastics bodies, endless profiles, slabs, foils, fibers, films and coatings. Although the coloring of fibers is mentioned along with a multitude of possibilities, no specific compositions of fibers which comprise perylene pigments, or applications thereof in heat management are disclosed.

For practical or esthetic reasons, materials which comprise fibers are frequently dark-colored, for example brown, gray or black. Frequently, dark hues of red or green are also encountered. When these materials are exposed to the influence of light or of solar irradiation, they are heated, frequently significantly in accordance with their color depth. Such heating of materials which comprise fibers is often perceived as unpleasant in the case of, for example, clothing, woven fabrics or else fabric covers. Firstly, the heating of the material gives rise to an unpleasant impression of increased temperature on the skin surface which comes into contact with the materials directly or through the clothing; secondly, such heating in interiors contributes, through thermal radiation which is emitted again by the dark materials, to increased temperature in the room, which in turn has to be regulated, for example, by air conditioning with high energy consumption.

It is therefore an object of the present invention to provide fibers with high color strength, but also gray or black fibers, which, under the action of light, especially of solar radiation, on materials which comprise such fibers, have reduced heating compared to materials which consist of conventionally colored fibers. In addition, these fibers should be producible with the conventional apparatus for producing fibers.

It was a further object of the invention to provide colored fibers which can be processed with the aid of the conventional apparatus to materials comprising these fibers, the colored fibers having a high stability toward light and environmental influences.

The object is achieved by fibers which comprise IR-transparent colorants.

In the context of the invention, "colorants" are understood to mean dyes or pigments.

Colored fibers are fibers which, as a fiber bundle, have a colored appearance on visual inspection. Colored fibers are preferably understood to mean dark-colored fibers, especially black, brown or gray fibers. Also included here are light gray or light brown fibers.

In one embodiment, the fibers comprise what are known as dichromatic, trichromatic, or polychromatic dye mixtures (mixtures comprising two, three or more than three colorants) as IR-transparent, especially black, colorants. The trichromatic dyes comprise dye mixtures of three dyes, whose overall visual impression for the observer is especially a black or dark color impression. Examples of such dye mixtures are known to those skilled in the art from EP1240243. Here, colorant combinations selected from the dyes of pyrazolone, perinone, antraquinone, methine, azo and coumarin type are described.

IR-transparent colorants which are also used in the inventive fibers are metallic pigments, such as inorganic pigments and metal complexes of azo, azomethine or methine dyes, and those of the azomethine, quinacridone, dioxazine, isoindoline, isoindolinone, phthalocyanine, pyrrolopyrrole and thioindigo type and bismuth vanadate.

In a preferred embodiment, as IR-transparent colorants, according to the invention, perylene pigments, preferably black perylene pigments, especially those which comprise one of the isomers of the formula Ia or Ib Ia

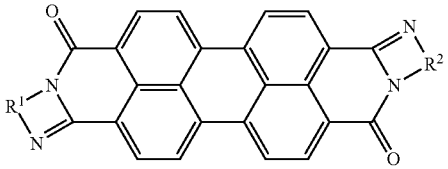

Ib

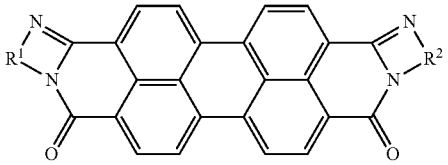

in which the $R^1$ and $R^2$ radicals are each independently phenylene, naphthylene or pyridylene, each of which may be mono- or polysubstituted by $C_1$-$C_{12}$-alkyl, $C_1$-$C_6$-alkoxy, hydroxyl and/or halogen, or a mixture of the two isomers. Very preferably, those perylene pigments or mixtures thereof which have a blackness value of ≥210 in an alkyd/melamine baking varnish are used.

The term "mixture" shall comprise physical mixtures and also preferably solid solutions (mixed crystals) of the compounds Ia and Ib.

The phenylene, naphthylene and pyridylene $R^1$ and $R^2$ radicals in the formulae Ia and Ib may be mono- or polysubstituted by $C_1$-$C_{12}$-alkyl, especially $C_1$-$C_4$-alkyl, $C_1$-$C_6$-alkoxy, in particular $C_1$-$C_4$-alkoxy, hydroxyl and/or halogen, especially chlorine or bromine.

However, the phenylene, naphthylene and pyridylene radicals are preferably unsubstituted, preference being given to the phenylene and naphthylene radicals and particular preference to the naphthylene radicals.

The black perylene pigments used with preference in the fibers in accordance with the invention absorb over the entire visible spectral region and are thus notable for their high blackness. The perylene pigments preferably have, in an alkyd/melamine baking varnish, a blackness value $M_Y$ of ≥210, more preferably ≥230. The blackness value is determined here analogously to test method B1 of WO 2005/078023 A2 (page 27, lines 24-38). To determine the blackness value, a mixture of in each case 1.0 g of the particular pigment and 9.0 g of an alkyd/melamine baking resin (binder content of 43% by weight, adjusted to 35% by weight with xylene) is shaken with 10 ml of glass beads (diameter 3 mm) in a 30 ml glass bottle on a Skandex dispersing unit for 60 min. The resulting paste is subsequently applied as a 150 mm-thick layer to cardboard, air-dried and baked at 130° C. for 30 min. After colorimetric evaluation with a spectrophotometer, preferably a Spectraflash SF 600 Plus from Datacolor, the blackness value is calculated by the following formula from the standard color value Y: blackness value=100×log(100/Y).

Accordingly, they generally result in a deep black, neutral full shade coloration of the fibers. In a white reduction, neutral gray hues (e.g. perylene pigments Ia/Ib where $R^1$=$R^2$=naphthylene) to pale to distinct bluish colorations (e.g. perylene pigments Ia/Ib where $R^1$=$R^2$=phenylene) are obtained. It will be appreciated that it is possible to shade the colorations in a customary manner by means of small amounts of inorganic or organic pigments which can be added during the pigment finishing, as early as in the course of pigment synthesis or actually to the finished perylene pigment.

In the context of the present invention, infrared radiation (IR radiation for short) refers to electromagnetic waves in the spectral region between visible light and the longer-wavelength microwaves. This corresponds to a wavelength range from about 760 nm to 1 mm. In the case of short-wave IR radiation (from 760 nm to 1500 nm) reference is often made to near infrared (NIR). Infrared radiation is part of thermal radiation.

The perylene pigments used in the fibers in accordance with the invention are transparent in the NIR region (760 to 1500 nm); the transmittance of the pigments in the NIR is accordingly generally >60%, preferably >70%, more preferably >80%.

A test method for the determination of the property as an IR-transparent colorant is specified below: in the context of the present invention, IR-transparent means that, in the wavelength range from 760 to 1500 nm, at a concentration of 0.0625% by weight of homogeneously incorporated colorant in a polyvinyl chloride film (PVC film) within the wavelength range specified, the reduction of the transmittance compared to an otherwise identical PVC film of the same thickness, but without colorant—referred to hereinafter as standard—is at most 20%, preferably at most 15%, more preferably at most 10%, proceeding from the transmittance of the standard. For example, when the transmittance in the wavelength range specified of the standard at a particular wavelength is 90%, this results, in this numerical example, in a transmittance in the otherwise identical PVC film comprising 0.0625% by weight of the colorant of at least 70%, preferably at least 75%, more preferably at least 80%.

"Transparent" in wavelength range from 760 to 1500 nm preferably means that the transmittance of a polymer film of a thickness of 1 mm, into which 0.05 g of the colorant per 80 g of polyvinyl chloride have been incorporated homogeneously, in the wavelength range specified, is on average at least 65%, preferably at least 70%, especially at least 75%.

The transmittance is determined by recording, by means of an (N)IR spectrometer with a large Ulbricht sphere for integral capture of radiation in diffuse transmission, a transmission spectrum in the wavelength range specified. The corresponding test methods including the necessary calibration are sufficiently well known to those skilled in the art.

In order to determine the mean, a value of the transmittance is determined every 2 nm within the wavelength range specified and numerically weighted to determine the mean.

The specimen is produced, preferably by adding 0.05 g of the colorant to 80 g of polyvinyl chloride and then homogenizing on a Turbula mixer, and then rolling on a roll mill at 150° C. Subsequently, 4 rolled sheets thus obtained are stacked one on top of another and pressed between two metal plates preheated to 145° C. to give a rolled sheet package of thickness 1 mm.

The so-called absorption edge, i.e. the value at which the transmittance is 50% in a thus produced test specimen of thickness 1 mm and of a concentration of the colorant of 0.0625% by weight in the PVC film, is in the wavelength range from 700 to 950 nm, preferably from 750 to 900 nm, especially from 760 nm to 850 nm.

Frequently, the IR transparency, for the wavelength range of from 1500 nm to 2500 nm too, is also still at least 30%, preferably at least 40% and more preferably at least 50%.

The perylene pigments used in accordance with the invention generally have a primary particle size of ≤800 nm, preferably ≤500 nm, more preferably ≤200 nm (determined with reference to the particle size distribution in electron micrographs) and are of low dispersion hardness, i.e. they have, for example, in the coloring of plastics, a dispersion hardness DH of <5 to DIN 53775, sheet 7.

The perylene pigments may be prepared by prior art processes known to the those skilled in the art for pigment synthesis of perylene pigments. Advantageously, they are prepared by the processes described in WO 2005/078023 A2 (page 5, line 11-page 7, line 22) to which reference is made explicitly at this point, wherein the crude pigments obtained in the synthesis are subjected a) first to a comminution and then to a recrystallization in liquid medium or b) to a comminution with simultaneous recrystallization.

The crude pigments used in the preparation of the inventive perylene pigments can be prepared in a commonly known manner by condensing perylene-3,4:9,10-tetracarboxylic acid/dianhydride with the appropriate aromatic diamine at elevated temperature (for example from 150 to 250° C.) in a high-boiling organic solvent such as nitrobenzene, tri- and dichlorobenzene, α-chloronaphthalene, quinoline, tetralin, N-methylpyrrolidone, N,N-dimethylformamide, ethylene glycol, glacial acetic acid and cyclic urea derivatives (cf. for example, CH 373 844, GB 972 485, JP-A-07-157 681).

The crude pigments obtained here and also in other known preparation processes are obtained in the form of large crystals usually of very heterogeneous form, or else in the form of semi-amorphous powder.

A particularly suitable embodiment for the variant a) of the abovementioned preparation process consists in first subjecting the crude pigments to dry grinding in the presence or absence of a salt as a grinding aid and then to a recrystallization in an organic solvent, if desired in a mixture with water, under hot conditions. These steps are preferably performed as described in WO 2005/078023 A2 (page 7, line 24-page 10, line 29).

A particularly suitable preparation according to variant b) of the abovementioned preparation process consists in subjecting the crude pigments, in the presence of a recrystallizing organic solvent and of an inorganic salt, to kneading under hot conditions, as described in WO 2005/078023 A2 (page 10, line 31-page 12, line 33).

To control the crystal size of the black perylene pigments, it may be advantageous to perform the pigment finishing, i.e. the conversion of the crude pigments to the inventive perylene pigments, in the presence of pigment synergists, in which case typically from about 0.01 to 0.1 g of synergist is used per g of pigment. The pigment synergists may be added as early as in the preliminary comminution step, or else not until the recrystallization step.

Pigment synergists are compounds which comprise some or all of the pigment chromophore in their molecular structure. The structure of the pigment synergist need not correspond to the structure of the pigment whose crystallization is to be influenced. Thus, in the present case, not only pigment synergists based on the perylene structure but, for example, also those based on the copper phthalocyanine structure can be used. Particularly suitable pigment synergists are described in WO 2005/078023 A2 (page 13, line 12-page 14, line 14).

The presence of pigment synergists often also has a positive effect on the dispersibility and the flocculation stability of the inventive perylene pigments in the medium which is processed to the fiber, and/or within the fiber itself and hence also on the rheology of these systems.

The dispersibility of the inventive perylene pigments can additionally be improved by coating the pigment surface with conventional additives. In addition to additives based on rosin derivatives, additives based on natural and synthetic waxes are especially also suitable for the coloration of plastics. Examples include waxes based on polyethylene and on polypropylene, which may also be oxidized, on polyethylene oxide, on ethoxylated fatty alcohols, on polyethylene oxide/polypropylene oxide block copolymers, on fatty acid esters (e.g. montan waxes), on fatty acid amides and on ethylene/vinyl acetate copolymers.

The IR-transparent colorants, which are especially black, for example the dye mixtures or pigments, especially perylene pigments, are outstandingly suitable for coloring fibers. For this purpose, the colorants are incorporated into the fibers. Preference is given to using the above-described black perylene pigments to color the fibers.

The fibers here may consist of high molecular weight organic and inorganic substances of natural and synthetic origin.

The incorporation of the IR-transparent colorants, especially of the black perylene pigments, into the fibers can be effected, for example, into the high molecular weight organic or inorganic substances as early as before the actual fiber formation. However, it is also possible to incorporate the IR-transparent colorants, especially black perylene pigments, into the substances during fiber production, and, moreover, the IR-transparent colorants, especially perylene pigments, can also be incorporated into the fibrous organic or inorganic substances after the production of the fibers.

The inventive fibers comprise generally from 0.001 to 10% by weight of IR-transparent colorant (or mixtures thereof) based on the total weight of fiber and colorant. The fibers preferably comprise from 0.01 to 5% by weight, more preferably from 0.1 to 2% by weight and especially from 0.5 to 1.5% by weight.

Examples of high molecular weight synthetic organic materials include the following polymers:

polyolefins such as polyethylene, polypropylene, polybutylene, polyisobutylene and poly-4-methyl-1-pentene, polyolefin copolymers such as Luflexen® (Basell), Nordel® (Dow) and Engage® (DuPont), cycloolefin copolymers such as Topas® (Celanese), polytetrafluoroethylene (PTFE), ethylene/tetrafluoroethylene copolymers (ETFE), polyvinylidene difluoride (PVDF), polyvinylidene chloride, polyvinyl alcohols, polyvinyl esters such as polyvinyl acetate, vinyl ester copolymers such as ethylene/vinyl acetate copolymers (EVA), polyvinyl alkanals such as polyvinyl acetal and polyvinyl ketals, polyamides such as Nylon® [6], nylon [12] and nylon [6,6] (DuPont), polybutylene terephthalates and polyethylene terephthalates, polyesters such as polyethylene terephthalate (PET), polybutylene terephthalate (PBT) and copolymers, transesterification products and physical mixtures (blends) of the aforementioned polyalkylene terephthalates, polyurethanes, polystyrene, styrene copolymers such as styrene/butadiene copolymers, styrene/acrylonitrile copolymers (SAN), styrene/ethyl methacrylate copolymers, styrene/butadiene/ethyl acrylate copolymers, styrene/acrylonitrile/methacrylate copolymers, acrylonitrile/butadiene/styrene copolymers (ABS) and methacrylate/butadiene/styrene copolymers (MBS), polyethers such as polyphenylene oxide, polyether ketones, polysulfones, polyether sulfones, polyglycols such as polyoxymethylene (POM), polyaryls such as polyphenylene, polyarylenevinylenes, silicones, ionomers, thermoplastic and thermoset polyurethanes and mixtures thereof.

Particularly preferred polymers for the inventive fibers are polyolefins (polyethylene, polypropylene), polyesters (PET, PBT), polyamides or SAN. Very particular preference is given to polyolefins, polyesters, SAN.

Colorable plastics are understood to mean the polymers themselves, copolymers or blends thereof, which may be present in the form of powder, plastic materials, melts, or in the form of spinning solutions.

The incorporation of the IR-transparent colorants, especially the perylene pigments, into the fibers can be effected, for example, into the plastics as early as before the actual fiber formation, for example, in the form of pigment preparations (compound, master batch), in concentrations generally of from 1 to 90% by weight of colorant based on the total amount of plastic and colorants, preferably from 5 to 80% by weight, very preferably from 5 to 40% by weight. However, it is also possible to incorporate the IR-transparent colorants, especially black perylene pigments, into the polymers during the fiber production, for example in the form of a dispersion, and moreover, the colorants, especially perylene pigments, can also be incorporated into the plastics after the production of the fibers. The colorant or the colorant mixture is preferably incorporated in the form of pigment preparations.

It will be appreciated that the pigment preparations may comprise, as well as the IR-transparent colorants, further additives customary for plastics, for example, HALS compounds, UV absorbers (e.g. benzotriazoles, benzophenols, cyanoacrylates), flame retardants, antistats or (phenolic and phosphitic) antioxidants.

For example, the incorporation of the IR-transparent colorants, especially of the perylene pigments, into the pigment preparations of the polymers before the actual fiber formation can be effected by all known methods, for example, by combined extrusion (preferably with a single screw or twin-screw extruder), rolling, kneading, pressing or grinding.

After the incorporation, the polymers are then processed to fibers. The production process of the fibers from the polymers may be any desired process. For example, the fibers can be produced by spinning extrusion. It is possible to use all processes which are known to those skilled in the art and in which the colorants, which are especially black, especially perylene pigments, essentially or for the most part remain in the fiber, even after the production.

Examples of high molecular weight synthetic inorganic materials include:

low-melting borosilicate glass frits, unmodified or organically modified silicate sols and gels, undoped or doped silicate, aluminate, zirconate and aluminosilicate coatings produced via a sol-gel process, and sheet silicates. Preference is given to glass fibers.

The inventive fibers, especially fibers which are produced as described above from polymers, comprising IR-transparent colorants, may optionally comprise further additives. Suitable additives are the customary additives, for example other pigments (not corresponding to the formulae Ia and/or Ib or mentioned above) other dyes (not dichromatic, trichromatic or polychromatic) or dye mixtures, nucleating agents, fillers or reinforcing agents, anti-fogging agents, biocides, antistats, UV absorbers, light stabilizers, flame retardants or antioxidants.

The person skilled in the art selects, from the useful additives, preferably those which have essentially no absorption in the wavelength range from 760 nm to 1500 nm. Useful additives are especially those which are transparent to thermal radiation or those which have highly reflective properties within the wavelength range specified. Useful additives are especially those which are additionally stable under the processing conditions and do not adversely affect the polymer melt.

The person skilled in the art preferably selects additives such that they are transparent in the range from 760 nm to 1500 nm. The transmittance within the wavelength range specified is determined by the above-described process.

The additives preferably have a high thermal stability.

In a further embodiment, useful additives are those which have highly reflective properties with respect to thermal radiation in the near infrared wavelength range.

Highly reflective additives achieve the effect that the IR radiation is reflected and emitted. In this respect, the reflective additives bring about merely a change in the beam path of the radiation in the near infrared wavelength range before the thermal radiation is subsequently emitted.

Useful additives which reflect in the near infrared wavelength range include extraneous particles which scatter significantly within the wavelength range specified, especially titanium dioxide pigments and inorganic mixed phase pigments (e.g. Sicotan® pigment, BASF) or extraneous particles with high reflection in the near infrared wavelength range, such as aluminum flakes and luster pigments, for example those based on coated aluminum flakes or inorganic salts/oxides such as chromium titanates, nickel titanates.

In general, the additives are present in an amount of from 0 to 30% by weight based on the total weight of fibers and additives. Preference is given to using from 2 to 20% by weight, especially from 5 to 15% by weight, of additives.

Suitable other pigments as additives are inorganic pigments, for example titanium dioxide in its three modifications: rutile, anatase or brookite, ultramarine blue, iron oxide, bismuth vanadates or carbon black, and the class of the organic pigments, for example compounds from the class of the quinophthalones, diketopyrrolopyrroles.

Dyes are understood to mean all colorants which dissolve completely, or are present in molecularly dispersed distribution in the plastic used and hence can be used for high-transparency, non-scattering coloration of polymers. Likewise considered to be useful as dyes are organic compounds which have fluorescence in the visible region of the electromagnetic spectrum, such as fluorescent dyes.

Suitable nucleating agents comprise, for example, inorganic substances, for example, talc, metal oxides such as titanium dioxide or magnesium oxide, phosphates, carbonates or sulfates of preferably alkaline earth metals; organic compounds such as mono- or polycarboxylic acids and salts thereof, for example, 4-tert-butylbenzoic acid, adipic acid, diphenylacetic acid, sodium succinate or sodium benzoate; polymeric compounds, for example ionic copolymers ("ionomers").

Suitable fillers or reinforcing agents comprise, for example, calcium carbonate, silicates, talc, mica, kaolin, barium sulfate, metal oxides and hydroxides, carbon black, graphite, wood flour and flours or fibers of other natural products, synthetic fibers. Examples of fibrous and pulverulent fillers, also include carbon or glass fibers in the form of glass fabrics, glass mats or filament glass rovings, chopped glass, glass beads, and wollastonite. Glass fibers can be incorporated either in the form of short glass fibers or in the form of continuous fibers (rovings).

Suitable antistats are, for example, amine derivatives such as N,N-bis(hydroxyalkyl) alkylamines or -alkyleneamines, polyethylene glycol esters and ethers, ethoxylated carboxylic esters and carboxamides, and glyceryl mono- and distearates, and mixtures thereof.

In a preferred embodiment of the inventive fibers comprising black colorants, especially perylene pigments, titanium dioxide ($TiO_2$) is present as an additive. In general, $TiO_2$ is present in an amount of 0 to 30% by weight based on the total weight of fiber and additives. Preference is given to using from 2 to 20% by weight, especially from 5 to 15% by weight, of $TiO_2$.

Particular preference is given to inventive fibers, which, as well as polyesters, especially PET, or SAN, comprise black perylene pigments, especially those of the formulae Ia and/or Ib, and also $TiO_2$. Such fibers are especially suitable as an embodiment of matt or gray fibers.

One possible explanation for heat management with black NIR-transparent pigments is that the fibers transmit NIR radiation unhindered. Frequently, the radiation transmitted is then reflected or emitted again on a light, especially white, surface behind the material which comprises the inventive fibers. The radiation is thus not absorbed in the material or in the volume surrounded by the material and there is no "heating" of the material or of the space behind the material, in spite of the dark, for example black, color impression that the material gives to the observer.

In a preferred embodiment, a further material with a light, especially white, surface is therefore behind the inventive materials (on the side essentially facing away from the incidence of light or of the solar radiation), which comprise the inventive fibers.

In a further preferred embodiment, the inventive fibers, especially those based on plastics, as well as the IR-transparent colorants, especially black perylene pigments, also comprise small amounts of $TiO_2$. One advantage of this embodiment of the inventive fibers is that it is unnecessary to arrange a light-colored surface behind the material which comprises these fibers. Surprisingly, the small proportion of $TiO_2$ is sufficient to partly or even entirely prevent heating of the material and thus to perform heat management with the aid of these materials.

Some selected fields of use which are of particular interest for the inventive fibers comprising IR-transparent colorants, especially perylene pigments, are cited hereinafter by way of example.

The production of materials, especially textiles or fabrics, from fibers is known to those skilled in the art. For example, mention should be made here of spinning and weaving processes for processing of fibers to give, or for processing fibers into, textiles and fabric. These processes can also be used for the processing of the inventive fibers to give, or the incorporation into, materials.

One field of interest is that of use in dark, for example black, brown or gray materials, especially textiles and fabrics, in interiors which are subject to the influence of light, especially of solar radiation. For example, this includes clothing, seats or seat covers in the interior of vehicles, especially passenger vehicles, buses or trucks, which comprise materials comprising dark-colored fibers.

In a preferred embodiment, the inventive textiles are dark automobile seat covers, which adjoin a light-colored foam material, for example polyurethane foam.

In addition, these textiles and fabrics find use in dark-colored, especially black-colored, sunblinds, awnings, roller blinds or curtains.

In addition, these textiles and fabric find use in dark-colored, especially black-colored, geotextiles, mulch films, tents or textiles and fabrics for outdoor uses.

In addition, it is also possible to use the textiles and fabrics for dark clothing or else dark seat covers outdoors, for example for stadium seats.

The inventive fibers comprising perylene pigments of the formula Ia and/or Ib, in which $R^1$ and $R^2$ are each phenylene are particularly suitable for all these applications, since these pigments have a marked absorption in the visible range from 400 to 800 nm and are transparent in the NIR region (band edge about 850 nm). The inventive perylene pigments of the formula Ia and/or Ib, in which $R^1$ and $R^2$ are naphthylene, which likewise absorb strongly in the visible region and are transparent in the NIR region (band edge approx. 950 nm), are likewise very suitable.

Further advantages of these perylene pigments in the inventive fibers are a neutral black color, heat stability of up to 300° C. in the fiber and up to 450° C. in bulk, high color strength, low tendency to migrate, low solubility in organic solvents, high stability to light and environmental influences, chemical inertness and simple dispersibility.

The invention therefore further provides materials, comprising the inventive fibers, for example textiles or fabrics.

The invention is illustrated in detail by the examples which follow, without the examples restricting the subject matter of the invention.

EXAMPLES

Production of the Fibers

A masterbatch in PBT, comprising 40% by weight of IR-transparent colorant based on the total amount of PBT and IR-transparent colorant, was prepared. This masterbatch was used in a ratio of 1:10 to produce a PET fiber. The fibers were produced by spinning extrusion and then air-textured. The spectroscopic measurements (reflectance measurements) were carried out on a wound fiber bundle (Ulbricht sphere 300-2500 nm).

The following IR-transparent colorants were used:

F1:
Isomer mixture:

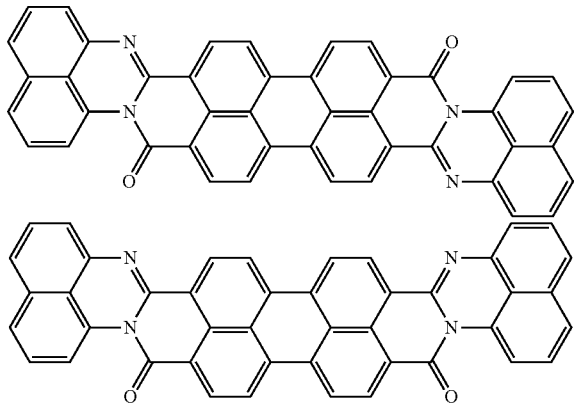

F2:
Isomer mixture:

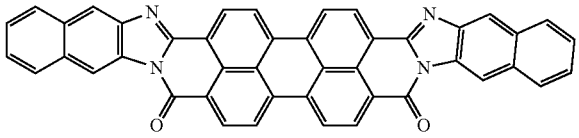

-continued
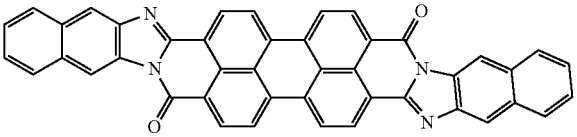
F3:
Isomer mixture:
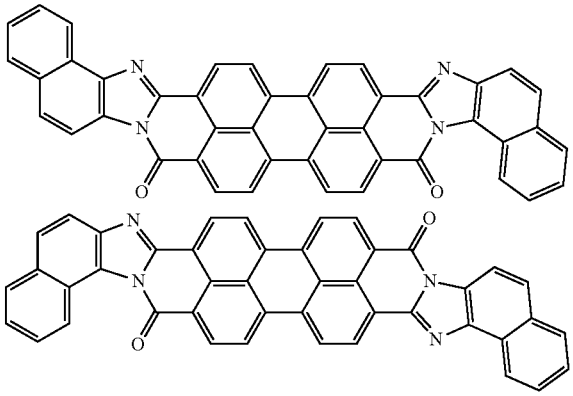
F4:
Isomer mixture:
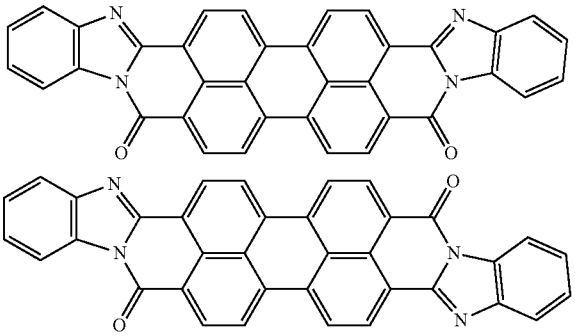
F5:
Isomer mixture:
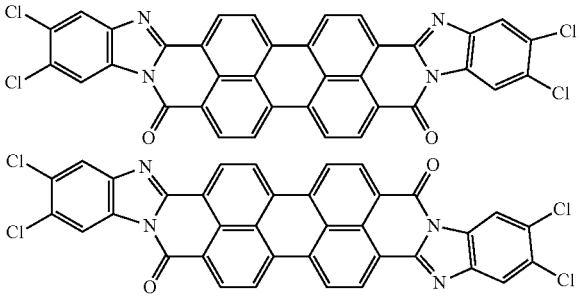
F6:
Isomer mixture:
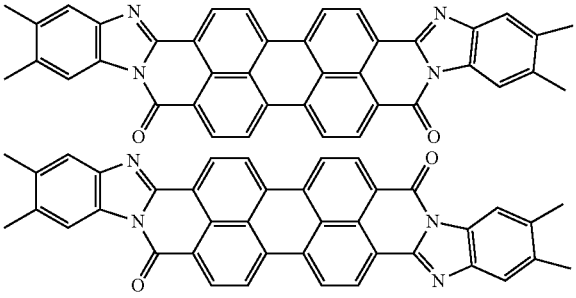
-continued
F7:
Isomer mixture:
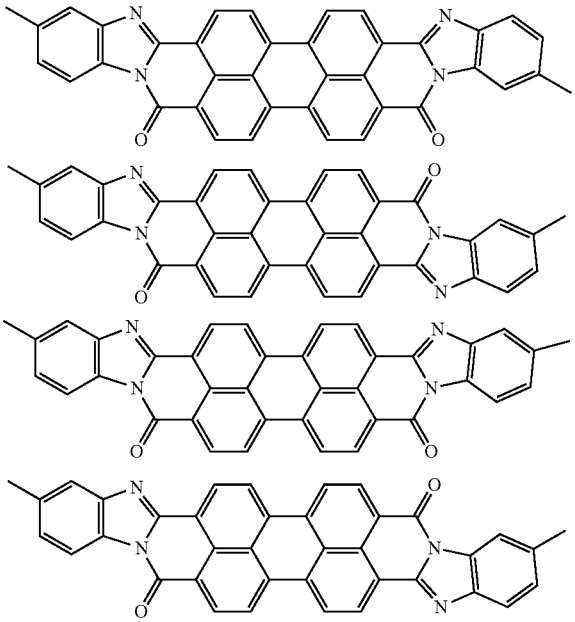
F8:
Isomer mixture:
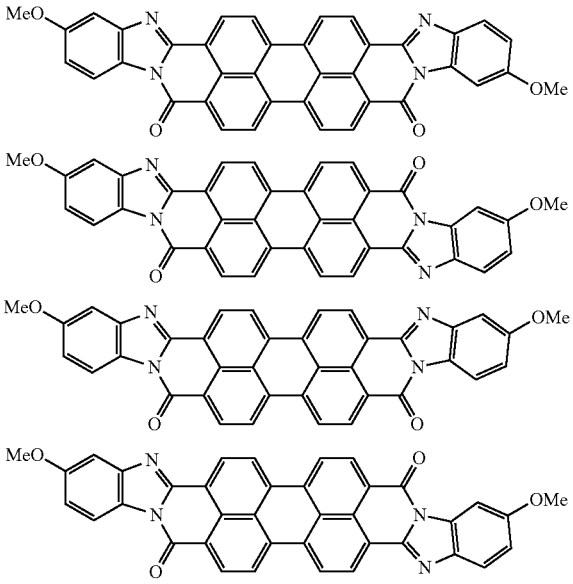
F9:
Isomer mixture:
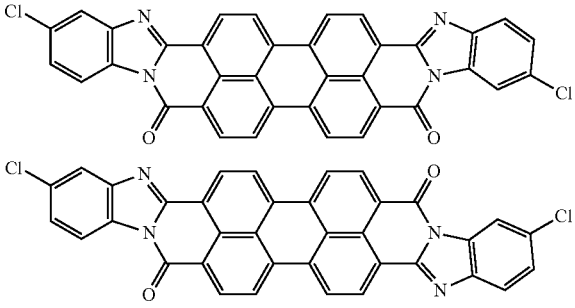

-continued

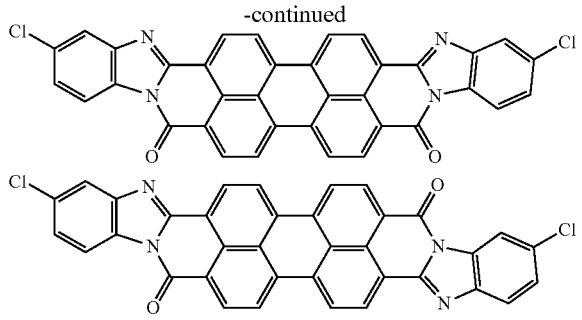

The colorants F1 to F9 were prepared as specified in WO 2005/078023 A2.

Example 1

Reflectance of NIR Radiation of a Black Fiber Bundle in the Wavelength Range from 760 to 1500 nm in Front of a White Surface The reflectance was higher than 70% for all colorants F1 to F9.

In comparison, the reflectance for fibers into which carbon black had been incorporated under the same conditions as the colorants within the above-specified wavelength range was less than 5%.

Example 2

Reflectance of NIR Radiation of a Black Textile for Automobile Interiors in the Wavelength Range from 760 to 1500 nm in Front of a White Surface The reflectance was higher than 60% for all colorants F1 to F9.

In comparison, the reflectance for fibers into which carbon black had been incorporated under the same conditions as the colorants within the above-specified wavelength range was less than 5%.

Example 3

Reflectance of NIR Radiation of a Gray Textile for Automobile Interiors in the Wavelength Range from 760 to 1500 nm in Front of a White Surface The reflectance was higher than 60% for all colorants F1 to F9.

In comparison, the reflectance for fibers into which carbon black had been incorporated under the same conditions as the colorants within the above-specified wavelength range was less than 30%.

The invention claimed is:

1. A polyester fiber, comprising from 0.5 to 10% by weight an IR-transparent colorant based on the total weight of fiber and colorant, the IR-transparent colorant is a perylene pigment and comprises one of the isomers of the formula Ia or Ib Ia

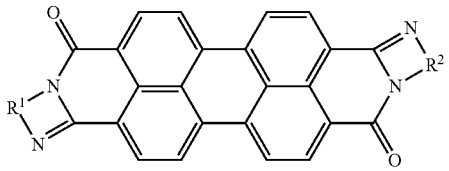

Ib

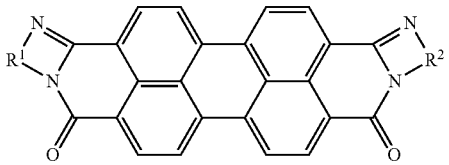

in which the $R^1$ and $R^2$ radicals are each independently phenylene, naphthylene or pyridylene, each of which may be mono- or polysubstituted by $C_1$-$C_{12}$-alkyl, $C_1$-$C_6$-alkoxy, hydroxyl and/or halogen, or a mixture of the two isomers; and 2 to 20% by weight of titanium dioxide as an additive based on the total weight of the fiber and the additive, wherein the fiber has a reflectance of at least 60.

2. The fiber according to claim 1, which is a black, brown or gray fiber.

3. A process for producing a fiber according to claim 1, which comprises coloring a fiber with the aid of an IR-transparent colorant.

4. A material comprising a fiber according to claim 1.

5. The material according to claim 4, which, behind the fiber, has a light or white surface.

6. The material according to claim 4, wherein the material is a textile or a fabric.

7. The material according to claim 6, wherein the textile or fabric is a sunblind, an awning, a roller blind, a curtain, a geotextile, a mulch film, a tent, a textile and a fabric for outdoor use, clothing or a seat cover.

* * * * *